US006991230B1

(12) United States Patent
Shoemaker

(10) Patent No.: US 6,991,230 B1
(45) Date of Patent: Jan. 31, 2006

(54) REVOLVING TARGET AMUSEMENT APPARATUS

(76) Inventor: Stephen P. Shoemaker, 531 N. Francisca Ave., Redondo Beach, CA (US) 90277

( * ) Notice: Subject to any disclaimer, the term of this patent is extended or adjusted under 35 U.S.C. 154(b) by 0 days.

(21) Appl. No.: 10/990,308

(22) Filed: Nov. 16, 2004

(51) Int. Cl.
*A63F 7/00* (2006.01)

(52) U.S. Cl. ..... 273/108; 273/126 R; 273/356; 273/127 D

(58) Field of Classification Search ..... 273/126 R, 273/356, 108–111, 127 R, 127 D, 440, 447, 273/448
See application file for complete search history.

(56) References Cited

U.S. PATENT DOCUMENTS 4,061,334 A * 12/1977 Kanno ..... 273/126 A
4,225,140 A * 9/1980 D'Andrade et al. ..... 273/356
4,272,082 A 6/1981 Shoemaker, Jr.
4,303,248 A 12/1981 Shoemaker, Jr. et al.
4,726,585 A 2/1988 Shoemaker, Jr.
4,807,886 A * 2/1989 Van Elderen et al. ..... 273/356
5,417,435 A * 5/1995 Peretz ..... 273/355
5,553,865 A 9/1996 Shoemaker, Jr. et al.
5,664,776 A * 9/1997 Mateer ..... 273/126 R
5,667,217 A * 9/1997 Kelly et al. ..... 273/126 R
5,855,374 A 1/1999 Shoemaker, Jr.
6,095,519 A 8/2000 Shoemaker, Jr.
6,139,429 A 10/2000 Shoemaker, Jr.
6,206,370 B1 * 3/2001 Halliburton ..... 273/138.1
6,520,500 B2 * 2/2003 Pierce et al. ..... 273/108
6,598,881 B1 7/2003 Shoemaker, Jr.
6,770,001 B1 8/2004 Shoemaker, Jr.

* cited by examiner

*Primary Examiner*—Raleigh W. Chiu
(74) *Attorney, Agent, or Firm*—Fulwider Patton, LLP

(57) ABSTRACT

An amusement device in the form of an arcade game is disclosed that comprises a rotating playing field arrayed with targets at the perimeter. Using a projectile such as a token or coin, the player drops the projectile into a chute in an attempt to knock down the targets on the rotating playing field. If the player knocks over a target with the projectile, the target is recognized by a detector and then returned to its original position for subsequent play.

10 Claims, 4 Drawing Sheets

REVOLVING TARGET AMUSEMENT APPARATUS

FIELD OF THE INVENTION

This invention relates generally to amusement devices, and more particularly to an arcade-type game where game pieces are aimed down a ramp and across a rotating playing field at targets at the periphery of the rotating playing field.

BACKGROUND OF THE INVENTION

Arcade games that measure a player's skill and luck are well known in the art. The present inventor is also the inventor and owner of many popular games found in today's' arcades. For example, U.S. Pat. No. 4,272,082, entitled "Coin Projecting Amusement Device," discloses an amusement device wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory and then the game vends out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin.

U.S. Pat. No. 5,553,865 discloses a rotary arcade game including a turn table having a central aperture. Prizes are positioned on the surface of the turn table and moved by a pivoting arm member operated by the player. The player attempts to manipulate the arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turn table, and the player manipulates a vacuum pick up device linearly along a radial direction of the turn table to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

The foregoing illustrate arcade type games credited to the present inventor. The games are predominantly skill-based with an element of luck woven into the overall operation of the games. The present invention is the inventor's most recent creation in this line of arcade type games.

SUMMARY OF THE INVENTION

The present invention is directed to an arcade type game wherein a rotating playing field such as a turn table includes a series of targets arrayed around the perimeter. Each target is pivotally mounted to the perimeter of the rotating playing field about an axis tangential to the circumferential edge, such that the target rocks backward and forward in a radial direction. Each target is preferably equipped with a curved lip on an upper surface that serves as the mechanism for flipping the target when struck by a playing piece such as a token or coin. The game further includes an inclined chute to direct the game piece onto and across the rotating playing field with a horizontal velocity toward the revolving targets. If the game piece strikes the curved lip of a target, the target is flipped over by momentum of the game piece as the game piece rolls up the curved lip and off the playing field. The flipped target, having been struck by the playing piece, is pivoted off the playing field such that its distal end, referred to herein as the scoring end, points in a downward direction. The condition of the "hit" target is recognized by a stationary optical reader disposed adjacent the rotating playing field that detects any target pivoted off the playing field to the flipped over position. That is, when the target has been flipped over the scoring end of the target passes between a light source and a light sensor indicating that a target has been successfully tipped over. The sensor is connected to a computer that processes the signals from the sensor and credits the player with a successful score. A reward system, such as a redemption ticket disbursement, is preferably included in the game's architecture. Moreover, each target may have a unique scoring end that can be distinguished by the sensor and communicated to the computer. This allows the targets to have varying widths to provided differing levels of skill and increase the interest of the game. In a preferred embodiment of the present invention the chute can be controlled by the player manually to alter the trajectory of the game piece.

Other features and advantages of the invention will become apparent from the following detailed description, taken in conjunction with the accompanying drawings which illustrate, by way of example, the features of the invention

DETAILED DESCRIPTION OF THE INVENTION

Figure 1:
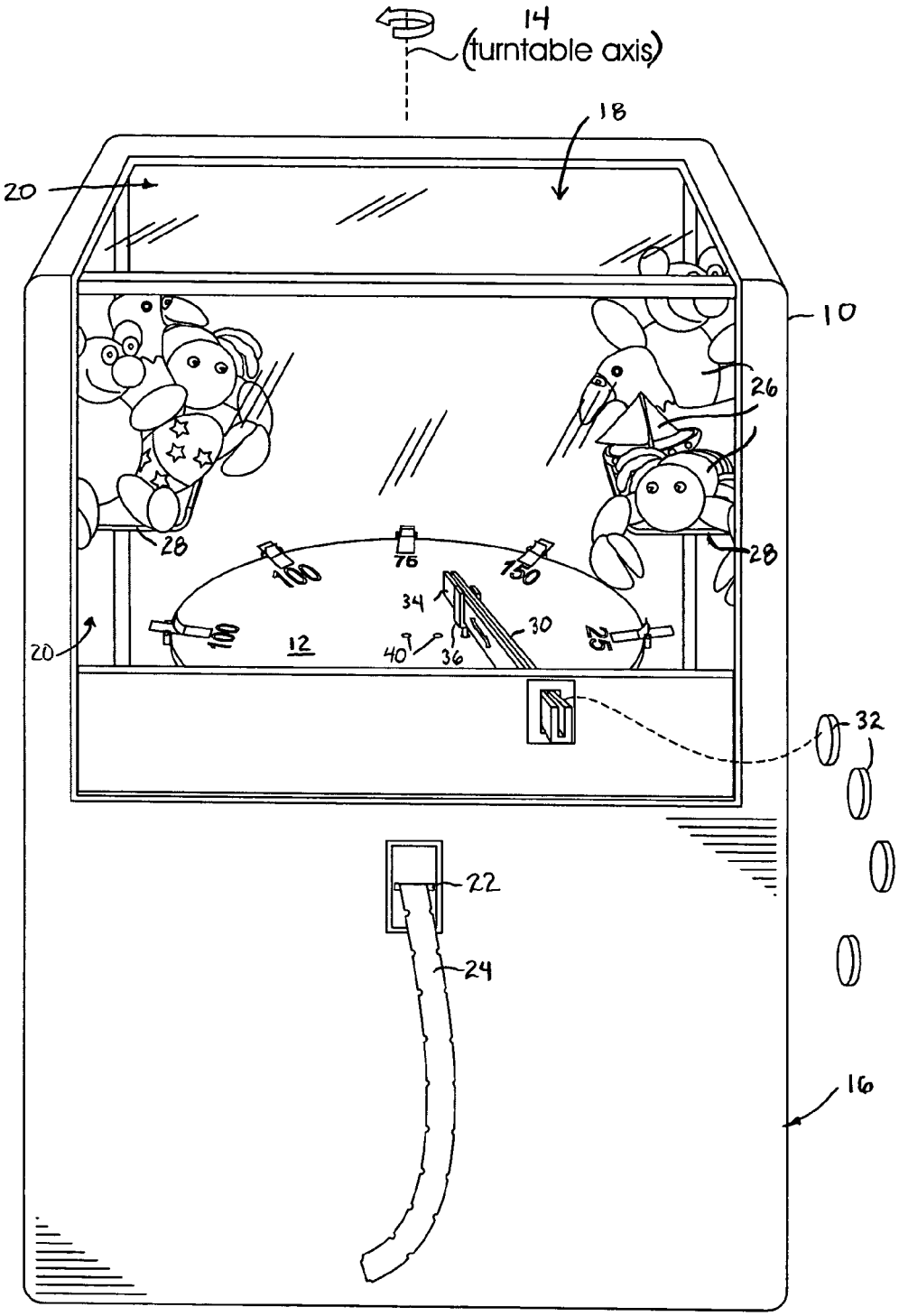
FIG. 1 is an elevated perspective view of a first preferred embodiment of the present invention.

The present invention, as shown generally in FIG. 1, is comprised of a housing 10 and a playing field in the form of a rotating turn table 12 disposed within an enclosed playing area and rotating about a vertical axis 14. The housing 10 includes a storage area 16 within a lower half to house the game's electronics and turntable motor assembly (not shown), and a viewing area 18 at the upper half including a plurality of transparent panels 20 for observing the playing area. The housing 10 may include a ticket distribution slot 22 for dispensing redemption tickets 24 at the conclusion of game play, where a ticket storage and dispensing system is disposed within the housing's storage area 16.

Within the housing 10 above the playing area may include prizes 26, enticements or other decorations displayed through said transparent panels 20 to encourage would-be players to participate. A shelf 28 can be provided to support such prizes for display within the viewing area 18.

Figure 2:
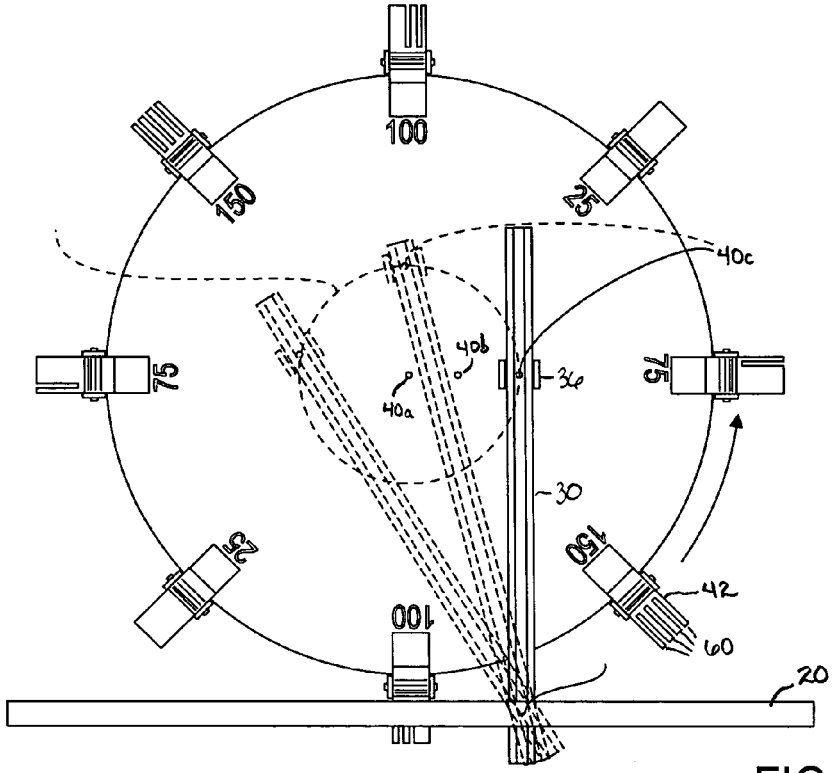
FIG. 2 is top view, partially in shadow, of the rotating playing field of the embodiment of FIG. 1.
Figure 3:
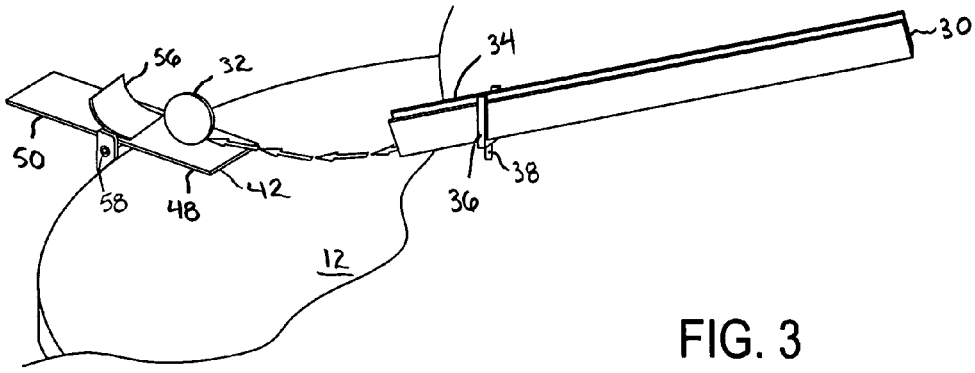
FIG. 3 is an elevated perspective view of the steering mechanism of the embodiment of FIG. 1.

Mounted to the rotating playing field 12 is a U-shaped coin chute 30 extending from an exterior of the housing 10. Coins 32 or other game pieces are dropped into the chute 30 by the player and the gravitational force on the coin causes it to travel down the chute 30 with a rolling motion toward and onto the playing field 12 (See FIG. 3). The end 34 of the chute 30 is positioned in a brace 36 on the rotating playing field 12 that may be moved to different positions. For example, the support peg 38 on the brace 36 can be inserted into one of several holes 40 on the playing field 12 from the center position 40*a* to slightly offcenter 40*b*, 40*c* (See FIG. 2). Because the center position 40*a* is the only stationary location on the rotation playing field 12, when the brace 36 is in the center hole 40*a* the chute 30 does not move as the turntable 12 rotates. This would correspond to the easiest or simplest game. Alternatively, with the brace peg 38 located in an offcenter hole 40*b*, 40*c*, the end 34 of the chute 30 within the brace 36 will rotate with the turntable 12 increasing the level of difficulty of striking a target 42 since both the target and the chute 30 are moving. The selection of the location of the brace 36 and chute end 34 is preferably controlled by the operator and not the player since access to the playing area is required.

Figure 4:
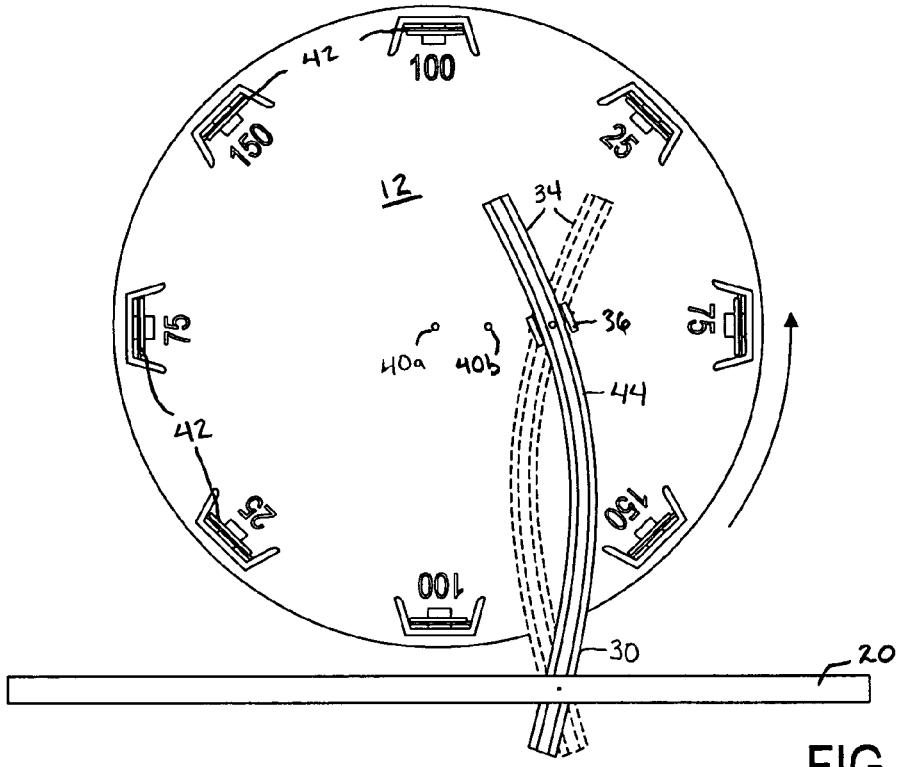
FIG. 4 is a top view of the rotating playing field of the embodiment of FIG. 1.

The chute 30 or game piece guiding mechanism is preferably of the type disclosed in U.S. Pat. No. 6,095,519, invented and owned by the present inventor, the contents of which are fully incorporated herein by reference. This type of chute includes a flexible portion 49 that the player can bend against the brace 36 forcing the chute to flex or bow in either direction. This flexing of the chute permits the player to have greater control over the trajectory of the game piece and adds to the complexity of the game (See FIG. 4). The player manipulates the shape of the chute 30 while the game piece 32 is traveling down the chute 30 to increase the control of the trajectory of the game piece 32 and enhance the skill level of the game. Further details of the steering mechanism are expanded upon in the '519 patent incorporated by reference, and not repeated herein for the sake of brevity.

Figure 5:
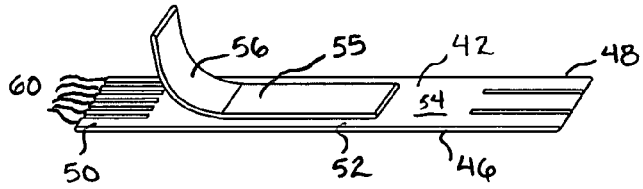
FIG. 5 is an elevated perspective view of a first preferred embodiment of a target of the embodiment of FIG. 1.
Figure 6:
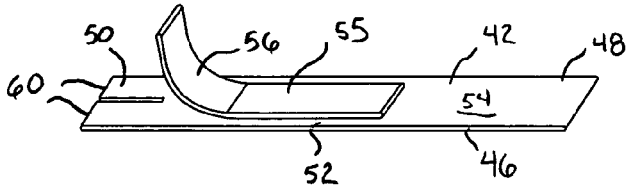
FIG. 6 is a second embodiment of a target of the embodiment of FIG. 1.

Two targets 42 are shown in FIGS. 5 and 6. The targets may each comprise a flat, planar member 46 with a proximal end 48 and a distal, or scoring end 50. At an intermediate section 52 of the target 42 on an upper surface 54 is an outwardly extending curved ramp element 55 terminating in an upturned lip 56. The upturned lip 56 is positioned at or near the fulcrum of the pivoting connection 58 mounting the target 42 to the rotating playing field 12, such that a horizontal force applied to the upturned lip 56 will flip the target 42 over on its axis. At the scoring end 50 of each target 42 is a series of fingers or projections 60 that identify the target 42 to the sensor 62. As the fingers 60 pass by the sensor 62 the sensor communicates the pattern to the computer (not shown) which recognizes which target 42 has been flipped. The computer then controls the ticket dispensing system to dispense redemption tickets 24 or prizes corresponding to an assigned exchange rate for the various targets. For example, the target 42 in FIG. 5 has six fingers 60 at the scoring end 50 that can be recognized by the sensor 62 and communicated to the computer, which identifies the specific target. FIG. 6 illustrates a target with only two fingers, which again can be recognized by the sensor and communicated to the computer for proper scoring. In this fashion each target 42 may be singularly identified by the sensor 62 if tipped over.

Figure 7A:
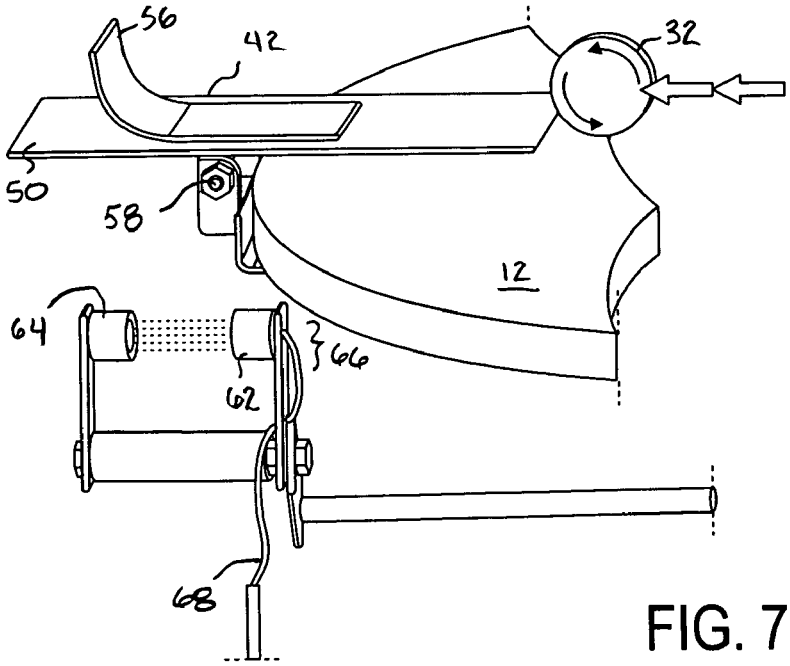
FIG. 7*a* is an elevated perspective view of the target and turntable combination in conjunction with the optical sensor of the embodiment of FIG. 1.
Figure 7B:
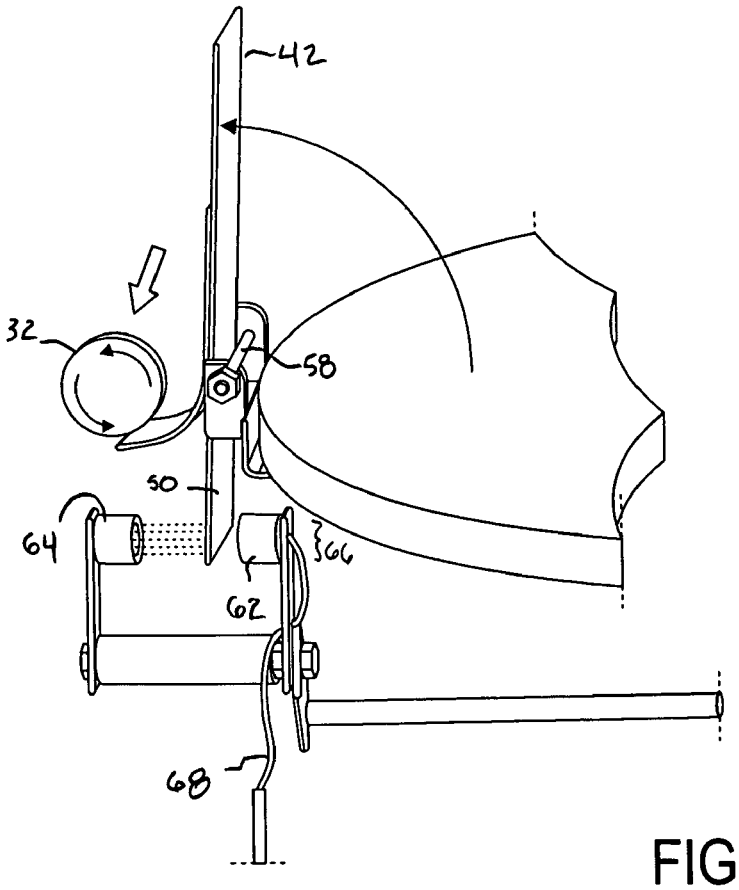
FIG. 7*b* is the target of FIG. 7*a* in the tipped over position.

FIGS. 7A and 7B illustrate the operation of the target 42 in combination with the sensor mechanism. The coin or token 32 exiting the chute 30 rolls toward a target 42 on the rotating playing field 12 as shown in FIG. 7A. The target 42 is balanced such that a slight majority of the weight of the target is forward of the pivot connection 58, causing the target to rest on top of the playing field. If the token 32 strikes the upturned lip 56 as shown in FIG. 7B, the force of the token against the lip tips the target 42 backward such that the scoring end 50 of the target 42 points downward vertically. As the playing field rotates, the scoring end 50 of the tipped over target 42 passes between a light source 64 and a photosensor 62 cooperating to form a detection unit 66. The detection unit 66 is capable of distinguishing between rapid interruptions in the light source 64 corresponding to multiple fingers 60 passing by the detection unit 66, and the signals generated therefrom are communicated via a cable 68 to a computer in the storage area 16 of the housing 10.

As the turntable 12 rotates, any tipped over targets are returned to their ready position so that the game is reset with every revolution of the turntable. This can be achieved by a simple sloped obstruction (not shown) that contacts the tipped over target and guides it to its original, horizontal position. After each rotation of the turntable the playing field 12 resets itself and all targets are returned to the original position. Scoring can be cumulative, with each successive target hit adding to the total, or the scoring can be based on a limited number of attempts. Also, the position of the brace 36 on the playing field 12 can result in a multiplier where the factor is one for the center position and a factor of greater than one is available for a non-center position.

In practice, the player approaches the game with tokens 32 that are individually placed in the entrance to the chute 30. Viewing the rotating playing field 12 through the transparent panels 20, the player can try to time the movement of the token 32 down the chute 30 and across the playing field 12 with the movement of the targets 42. Each token 32 rolls down the chute 30, which may be stationary if the brace 36 is located in the center 40*a* of the rotating playing field 12 or the chute 30 may be oscillating back and forth if the chute is positioned off-center 40*b*, 40*c*. As the token 32 rolls down the chute 30, it may come in contact with the target's upturned lip 56 portion causing the target 42 to tip over in a direction away from the center of the playing field 12. In the tipped over position, the target's distal end 50 extends vertically into a path between a light source 64 and a light sensor 62 adapted to detect the presence of the tipped over target 42 and identify which target has been tipped over. A signal is then sent to a computer which translates the signal and assigns a scoring value to the struck target. Using a reward system, the computer calculates a scoring value based on the number and value of each target hit, and rewards the player with tickets 24, prizes, or points. In a preferred embodiment, the player can manipulate the chute 30 to vary the trajectory of the token 32 or coin. Also, other game pieces are possible as projectiles such as steel balls and the like. Each tipped target is returned to its original position at a designated location along the perimeter of the playing field so that the game can be played indefinitely without having to manually reset the targets.

The above described embodiments of the present invention are intended to be exemplary and not exclusive. One of ordinary skill in the art will readily recognize that variations in the above described embodiments can be employed without departing from the spirit of the present invention. Accordingly, the scope of the present invention is not properly limited by any description above, but rather the invention's scope should be broadly interpreted by the ordinary meaning of the words of the claims appended hereto.

I claim:

1. An amusement device comprising:

a rotating playing field housed within an enclosure;

a target pivotally connected to said rotating playing field for movement between first and second positions;

a detector positioned adjacent the rotating playing field for determining said target in said second position; and a chute for carrying a game piece onto said rotating playing field, where contact between said game piece and said target transfers said target from said first position to said second position.

2. The amusement device of claim 1 further comprising a ticket distribution system for dispensing tickets in accordance with scoring based on the contact of the game piece with the target.

3. The amusement device of claim 1 wherein the chute is connected to the rotating playing field at a selected first position among a set of available positions.

4. The amusement device of claim 1 wherein said chute can be flexed to vary the trajectory of the game piece across the rotating playing field.

5. The amusement device of claim 1 further comprising a plurality of targets pivotally connected to said rotating playing field.

6. The amusement device of claim 5 wherein each target has a distinguishing feature readable by said detector to identify among the plurality of targets the target in said second position.

7. The amusement device of claim 5 wherein each target includes a distinguishing set of projections that are readable by said detector.

8. The amusement device of claim 1 wherein said detector is a light source and a photosensor operably connected to a computer.

9. The amusement device of claim 1 wherein each target is comprised of a flat, elongate member with an upturned lip member on an upper surface.

10. The amusement device of claim 1 wherein said game piece comprises a token.

* * * * *